US007537549B2

(12) United States Patent
Nelson et al.

(10) Patent No.: US 7,537,549 B2
(45) Date of Patent: May 26, 2009

(54) INCLINE ASSEMBLY WITH CAM

(75) Inventors: Gerald Nelson, Colorado Springs, CO (US); Rodney L. Hammer, Lewiston, UT (US); Gordon L. Cutler, Providence, UT (US); Kurt Finlayson, Wellsville, UT (US); William T. Dalebout, North Logan, UT (US)

(73) Assignee: Icon IP, Inc., Logan, UT (US)

( * ) Notice: Subject to any disclaimer, the term of this patent is extended or adjusted under 35 U.S.C. 154(b) by 622 days.

(21) Appl. No.: 10/788,799

(22) Filed: Feb. 27, 2004

(65) Prior Publication Data

US 2005/0032610 A1 Feb. 10, 2005

Related U.S. Application Data

(63) Continuation-in-part of application No. 09/496,569, filed on Feb. 2, 2000, now Pat. No. 6,761,667.

(60) Provisional application No. 60/542,437, filed on Feb. 6, 2004.

(51) Int. Cl.
*A63B 22/02* (2006.01)

(52) U.S. Cl. ..... 482/54; 482/51

(58) Field of Classification Search ..... 482/51, 482/52, 54

See application file for complete search history.

(56) References Cited

U.S. PATENT DOCUMENTS

| | | | | |
|---|---|---|---|---|
| 3,592,466 | A | 7/1971 | Parsons | 482/53 |
| 3,602,502 | A | 8/1971 | Hampl | 272/69 |
| 4,151,988 | A | 5/1979 | Nabinger | 272/69 |
| 4,544,152 | A | 10/1985 | Taitel | 272/69 |
| 4,659,074 | A | 4/1987 | Taitel et al. | 272/69 |
| 4,659,078 | A | 4/1987 | Blome | 272/128 |
| 4,687,195 | A | 8/1987 | Potts | 272/69 |
| 4,759,540 | A | 7/1988 | Yu et al. | 482/54 |
| 4,842,266 | A | 6/1989 | Sweeney, Sr. et al. | 272/69 |
| 4,848,737 | A | 7/1989 | Ehrenfield | 272/70 |
| 4,913,396 | A | 4/1990 | Dalebout et al. | |
| 4,927,136 | A | 5/1990 | Leask | 272/69 |

(Continued)

FOREIGN PATENT DOCUMENTS

| | | |
|---|---|---|
| WO | WO0156663 A1 | 8/2001 |

(Continued)

OTHER PUBLICATIONS

Damark International, Inc. Mail Order Catalog, dated Nov. 17, 1994, cover page and p. 6.

(Continued)

*Primary Examiner*—S. R. Crow
*Assistant Examiner*—Tam Nguyen
(74) *Attorney, Agent, or Firm*—Workman Nydegger

(57) ABSTRACT

An improved lift apparatus for use in a treadmill having a support base and a treadbase is disclosed. The lift apparatus includes a lift motor assembly linked to the support base and to a cam. The first cam can be attached to a torsion bar linked to the support base. An incline link bar is linked to the first cam and to the treadbase. The force generated by the motor assembly is efficiently translated from the cam to the treadbase, thereby inclining the treadbase.

25 Claims, 5 Drawing Sheets

U.S. PATENT DOCUMENTS

| | | | | |
|---|---|---|---|---|
| 5,029,801 | A | 7/1991 | Dalebout et al. | |
| 5,062,632 | A | 11/1991 | Dalebout et al. | 482/7 |
| 5,085,426 | A | 2/1992 | Wazner et al. | |
| 5,088,729 | A | 2/1992 | Dalebout | 482/54 |
| 5,145,475 | A | 9/1992 | Cares | 482/52 |
| 5,163,885 | A | 11/1992 | Wazner et al. | |
| 5,195,935 | A | 3/1993 | Fencel | 482/70 |
| D348,493 | S | 7/1994 | Ashby | D21/192 |
| 5,328,420 | A | 7/1994 | Allen | 482/52 |
| 5,328,422 | A | 7/1994 | Nichols | 482/52 |
| 5,352,166 | A | 10/1994 | Chang | 482/52 |
| 5,352,167 | A | 10/1994 | Ulicny | |
| 5,372,559 | A | 12/1994 | Dalebout et al. | |
| 5,382,209 | A | 1/1995 | Pasier et al. | 482/70 |
| 5,512,025 | A | 4/1996 | Dalebout et al. | 482/6 |
| 5,518,471 | A | 5/1996 | Hettinger et al. | 482/54 |
| 5,527,245 | A | 6/1996 | Dalebout et al. | 482/54 |
| 5,626,539 | A | 5/1997 | Piaget et al. | 482/54 |
| 5,674,453 | A | 10/1997 | Watterson et al. | 482/54 |
| 5,683,332 | A | 11/1997 | Watterson et al. | |
| 5,718,657 | A | 2/1998 | Dalebout et al. | |
| 5,733,228 | A * | 3/1998 | Stevens | 482/54 |
| 5,743,833 | A | 4/1998 | Watterson et al. | 482/54 |
| 5,810,696 | A | 9/1998 | Webb | 482/52 |
| 5,827,155 | A | 10/1998 | Jensen et al. | 482/54 |
| 5,833,577 | A | 11/1998 | Hurt | 482/54 |
| 5,860,893 | A | 1/1999 | Watterson et al. | 482/54 |
| 5,860,894 | A | 1/1999 | Dalebout et al. | 482/54 |
| 5,899,834 | A | 5/1999 | Dalebout et al. | 482/54 |
| 6,013,011 | A | 1/2000 | Moore et al. | 482/54 |
| D421,779 | S | 3/2000 | Piaget et al. | |
| 6,033,347 | A | 3/2000 | Dalebout et al. | 482/54 |
| 6,045,490 | A | 4/2000 | Shafer et al. | 482/54 |
| 6,050,921 | A | 4/2000 | Wang | 482/54 |
| 6,050,923 | A | 4/2000 | Yu | 482/54 |
| 6,053,844 | A | 4/2000 | Clem | 482/8 |
| 6,068,578 | A | 5/2000 | Wang | 482/54 |
| 6,110,076 | A | 8/2000 | Hurt | 482/54 |
| 6,132,340 | A | 10/2000 | Wang et al. | 482/54 |
| 6,174,268 | B1 | 1/2001 | Novak | 482/54 |
| 6,179,753 | B1 * | 1/2001 | Barker et al. | 482/54 |
| 6,231,482 | B1 | 5/2001 | Thompson | 482/37 |
| 6,234,936 | B1 | 5/2001 | Wang | 482/54 |
| 6,261,209 | B1 | 7/2001 | Coody | |
| 6,273,843 | B1 | 8/2001 | Lo | |
| 6,280,362 | B1 | 8/2001 | Dalebout et al. | 482/54 |
| D447,780 | S | 9/2001 | Arnold et al. | |
| D450,792 | S | 11/2001 | Kuo | |
| 6,312,363 | B1 | 11/2001 | Watterson et al. | 482/54 |
| 6,432,026 | B1 | 8/2002 | Wang et al. | |
| 6,461,275 | B1 | 10/2002 | Wang et al. | |
| 6,475,121 | B2 | 11/2002 | Wang et al. | |
| 6,533,707 | B2 | 3/2003 | Wang et al. | |
| 6,699,159 | B2 * | 3/2004 | Rouse | 482/54 |
| 6,761,667 | B1 * | 7/2004 | Cutler et al. | 482/54 |
| 6,913,563 | B2 | 7/2005 | Chen | |
| 6,974,404 | B1 * | 12/2005 | Watterson et al. | 482/54 |
| 7,285,075 | B2 | 10/2007 | Cutler et al. | |

FOREIGN PATENT DOCUMENTS

| | | |
|---|---|---|
| WO | WO03101543 A1 | 12/2003 |

OTHER PUBLICATIONS

Sears, Roebuck and Co., *ProForm 585 TL Low Profile Treadmill, User's Manual*, Copyright 1996 (20 pages).

Treadmill Owner's Manual by Formula 22100 Manual Treadmill, upon information and belief, available at least as early a 1998, 20 pgs.

Office Action dated Aug. 21, 2002 from U.S. Appl. No. 09/496,569 (3 pages).

Office Action dated Jun. 3, 2003 from U.S. Appl. No. 09/496,569 (3 pages).

Notice of Allowance dated Mar. 5, 2004 from U.S. Appl. No. 09/496,569 (6 pages).

Issue Notification from U.S. Appl. No. 09/496,569 (1 page).

Reebok User's Manual—ACD1 Treadmill, Copyright 1998 (26 pages).

Reebok User's Manual—ACD2 Treadmill, Copyright 1998 (28 pages).

Reebok User's Manual—ACD3 Treadmill, Copyright 1999 (32 pages).

Treadclimber by Nautilus, Copyright 2003 (1 page).

Reebok Store Reebok RX 7200 Treadmill w/10 workout options, http://store.reebok.com/product/index.jsp, Nov. 3, 2003 (14 pages).

Nordic Track 9800 Incline Trainer User's Manual, Copyright 2004 (43 pages).

International Search Report for PCT/DE02/02213, relating to WO03101543A1, disclosed in "Foreign Patent Documents," dated Nov. 18, 2002 (6 pages).

* cited by examiner

INCLINE ASSEMBLY WITH CAM

CROSS-REFERENCE TO RELATED APPLICATIONS

This application is a Continuation-in-Part Application of U.S. patent application Ser. No. 09/496,569, filed Feb. 2, 2000, now U.S. Pat. No. 6,761,667 and entitled "Hiking Exercise Apparatus," to Cutler, et al. which is incorporated herein by reference in its entirety. This application also claims priority to and the benefit of U.S. Provisional Patent Application Ser. No. 60/542,437, filed on Feb. 6, 2004, and entitled "Incline Motor with Cam Assembly", to Gerald Nelson, which is incorporated herein by reference in its entirety.

BACKGROUND OF THE INVENTION

1. The Field of the Invention

Exemplary embodiments of the present invention relate to the field of treadmills, and more specifically, to a motorized system used to raise and lower the inclination of a treadmill.

2. The Relevant Technology

The desire to improve health and advance cardiovascular efficiency has increased in recent years. This desire is coupled with the desire to exercise in locations that are within a limited space such as within an individual's home or an exercise gym. This trend has led to an increased desire for the production of exercise equipment.

For example, inclining exercise apparatuses, such as treadmills, have become very popular. Walking or running on an inclined surface requires a user to raise the user'knees in continual, strenuous strides. This requires more exertion than walking or running on a flat surface. Consequently, exercising on an inclined surface can provide a more intense, challenging workout.

Inclining apparatuses often include a lift mechanism such as a motor or motor/lever assembly for inclining and declining the treadbase. Lift motors used in these lift mechanisms often must be small and compact to accommodate the esthetic and space limitations inherent in the designs demanded by home and exercise gym consumers. The drawback of smaller more compact motors is that to provide the lifting force often demanded by such systems, the motors become impractically large or prohibitively expensive.

Additionally, some current designs have one or more lift motors that are positioned towards the front of the treadmill, and that push against the bottom portion of the treadbase. Unfortunately, this design is mechanically inefficient. For instance, the motors must initially generate several hundred pounds of force in order to provide only one hundred pounds of lift. This occurs because much of the initial force is directed backwards, thus pushing on the pivot point of the treadbase, instead of providing lift.

Increased lifting force is often required with the increased weight associated with more robust inclining apparatuses. The stronger components of the inclining elements of such apparatuses are also heavier than in the smaller units. More robust units are popular for commercial use, such as in exercise gyms, where repetitive use requires more sturdy construction. However, commercial use often demands more lifting force than the affordable and more compact lifting motors can provide.

Thus, a challenge presented in the art is to provide an incline assembly that is affordably compact. Additionally, the assembly should be capable of withstanding the rigors of both home and commercial use. Finally, the assembly should be mechanically efficient such that, for example, the force produced by the motor(s) is used efficiently.

BRIEF SUMMARY OF THE EXEMPLARY EMBODIMENTS

What is needed in the art is an exercise apparatus lift mechanism that overcomes the disadvantages listed above. An improved lift apparatus for use in an exercise device is disclosed. The exercise device has a support base and a moveable element, such as a treadbase, movably coupled thereto. The moveable element can be selectively raised and lowered relative to the support base. The improved lift apparatus includes a first lift motor assembly linked to a first cam. The first cam is also linked to the moveable element.

In an alternate exemplary embodiment, the improved lift apparatus also includes a second lift motor assembly linked to a second cam. In one embodiment, the first and second cams are attached to a torsion bar that is coupled to the support base. Actuating the lift motor assemblies drives the cams, applying a conveniently synchronized lift to the moveable element.

One exemplary embodiment is an improved lift apparatus for use in a treadmill having a support base and a treadbase pivotally coupled to the support base. The treadbase can be selectively inclined relative to the support base. The lift apparatus includes a first lift motor assembly linked to the support base and to a first cam. An incline link bar is coupled to the first cam and to the treadbase. A second lift motor assembly is linked to the support base and to a second cam. The first and second cams are attached to a torsion bar that is coupled to the support base, such that actuating the lift motor assemblies selectively raises or lowers the treadbase.

Exemplary embodiments of the improved lift device of the present invention provide several advantages over the prior art. Exemplary embodiments of the present invention are very mechanically efficient. Linking the cam(s) to the treadbase allows most of the force provided by the motors to be used to lift the treadbase.

In addition, the efficient dual motor system conveniently synchronizes the motors and allows for the use of smaller, more compact motors. This overcomes the problems associated with trying to fit a single, large motor in the limited space under the treadbase. Additionally, this dual motor system allows the motors to lift the treadbase frame to the desired angle, without the need to use complex and expensive synchronization mechanisms.

Finally, exemplary embodiments of the incline assembly with cam of the present invention prevent one side of the treadbase frame from being lifted at an angle with respect to the other side. This greatly reduces the possibility of mechanical failure of the lift mechanism due to the torsional forces exerted when one side of the treadbase frame is lifted and the other side is not. Since the dual motor incline assembly with cam(s) disclosed herein provides for the uniform and simultaneous lifting of both sides of the treadbase frame, these potential torsional forces are significantly reduced.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Figure 1:
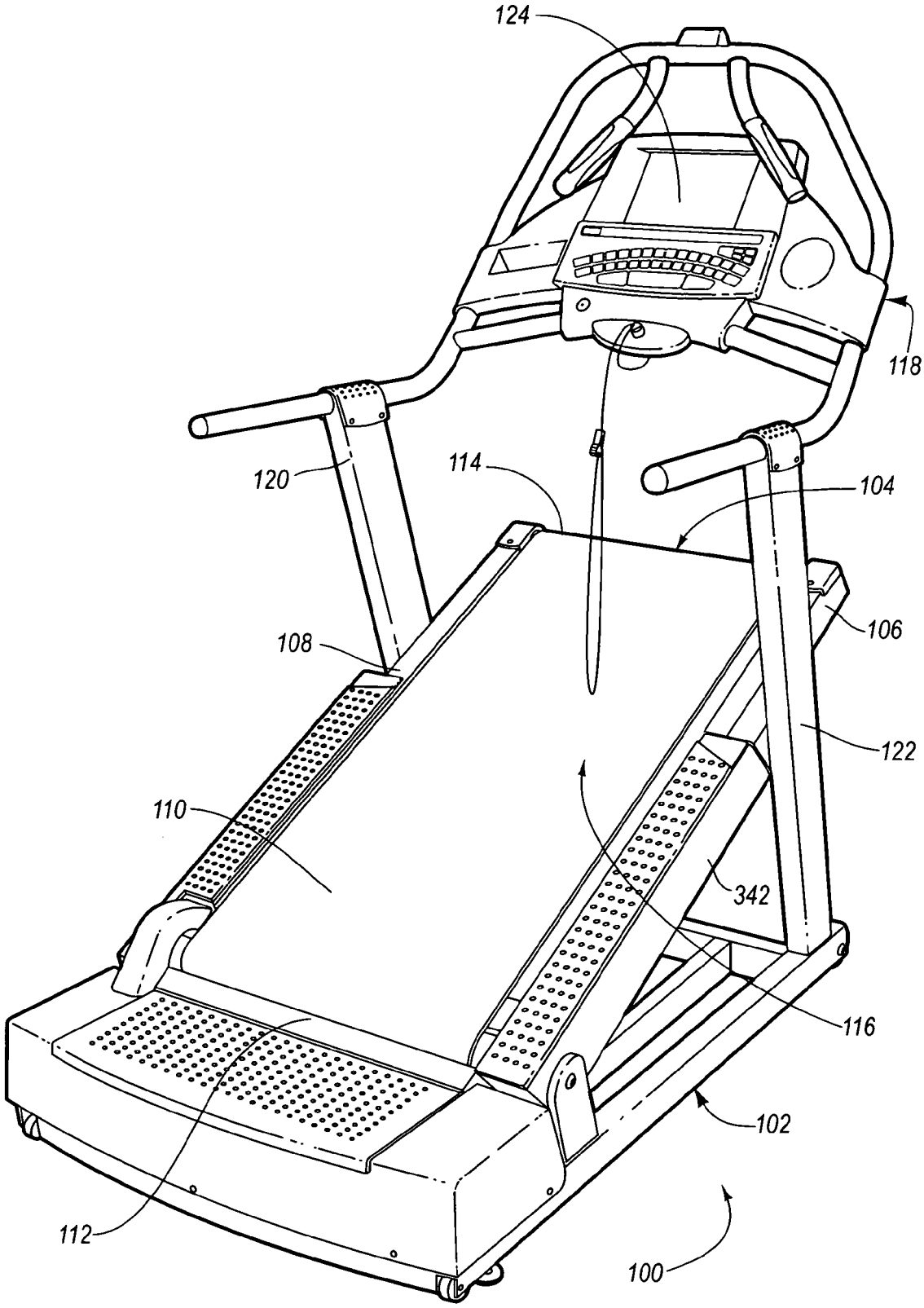
FIG. 1 is a perspective view of an exemplary exercise device in which the lift apparatus is used.
Figure 2A:
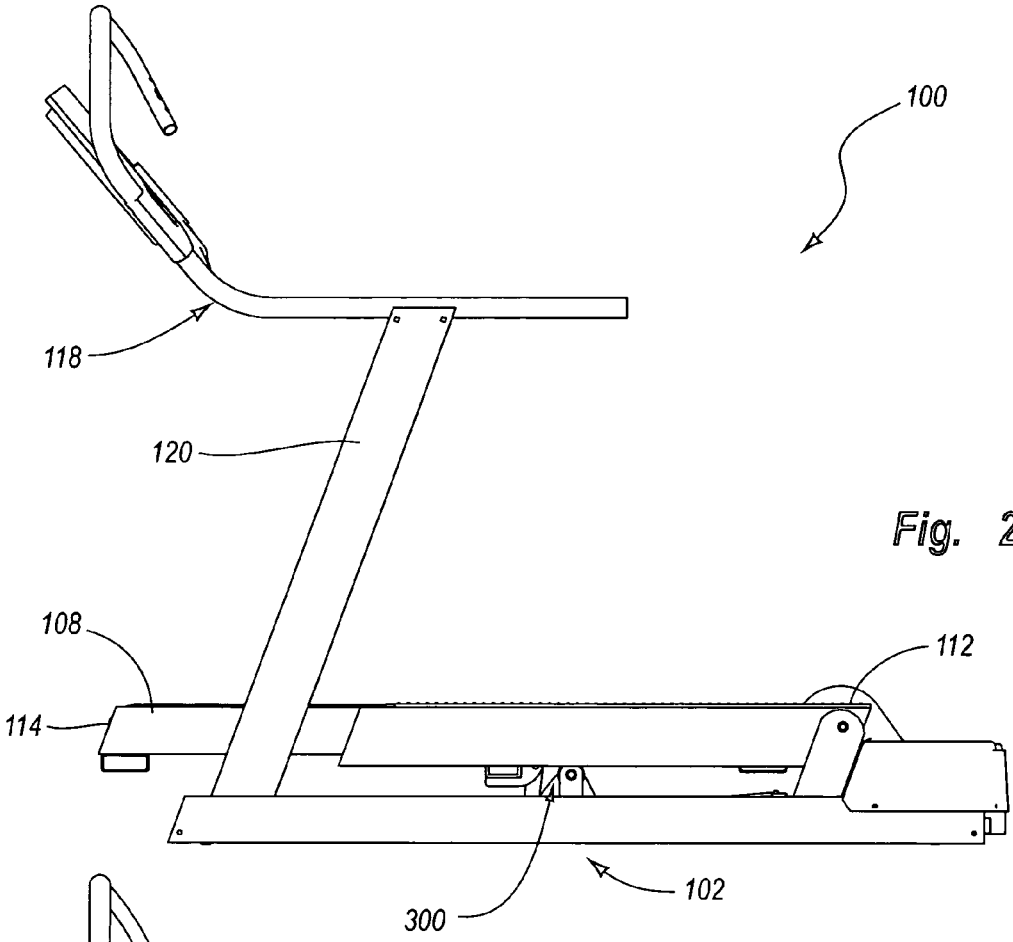
FIG. 2A is a side view of the treadmill of FIG. 1 with the treadbase in a horizontal position.
Figure 2B:
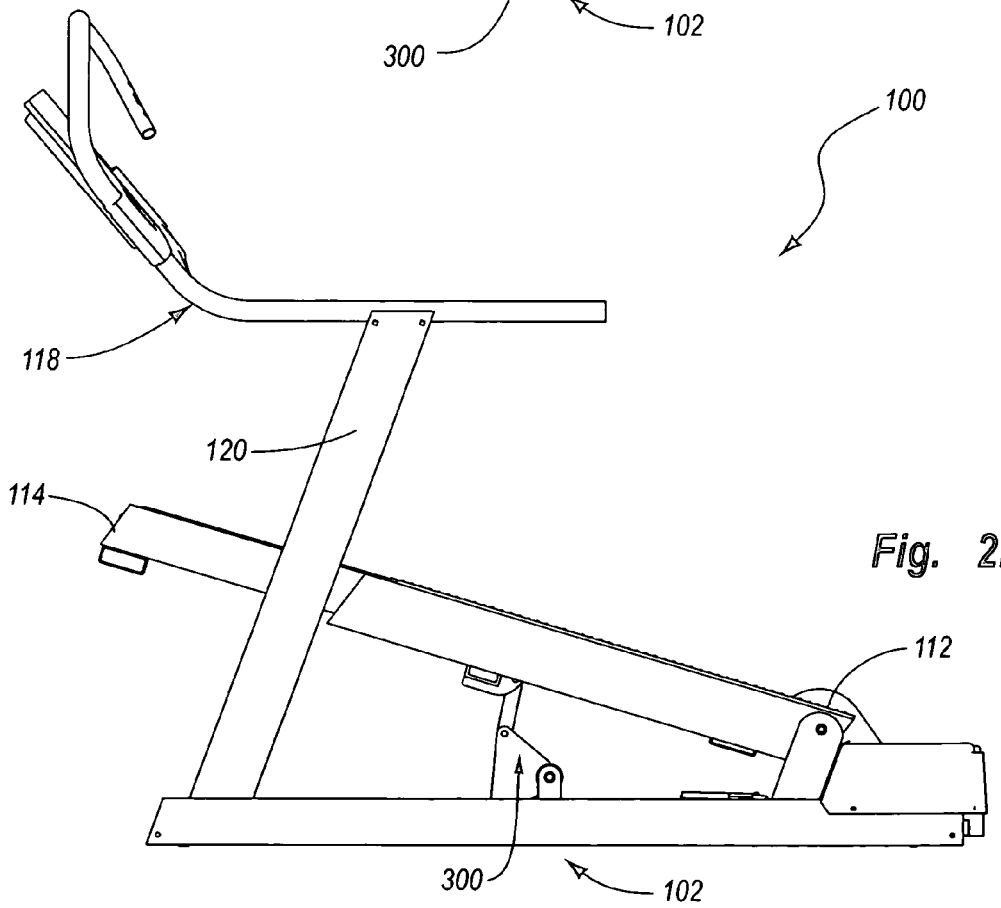
FIG. 2B is a side view showing the lift mechanism of the treadmill of FIG. 1 with the treadbase moved from the horizontal position of FIG. 1 to an inclined position.

With reference now to FIGS. 1, 2A and 2B, a selectively inclining and selectively declining exercise apparatus 100 in the form of a treadmill is shown which employs an exemplary embodiment of the present invention. Exercise apparatus 100 supports an ambulating user who wishes to hike, climb, walk or run on exercise apparatus 100. Exercise apparatus 100 includes a support base 102. Pivotally coupled to support base 102 is a selectively inclining treadbase 104.

Treadbase 104 includes (i) first and second elongate frame rails 106, 108 having a deck therebetween; (ii) first and second rollers mounted on opposing ends of first and second frame rails 106, 108; and (iii) an endless belt 110 trained about the rollers. Treadbase 104 has a rear end 112, a front end 114, and a middle portion 116 therebetween. Optionally, exercise apparatus 100 can include a drive motor assembly (not shown) to drive endless belt 110.

Treadbase 104 is one example of a movable element. However, a variety of different moveable elements may be movably coupled to the base 102 or to a variety of other support bases. Thus, base 102 is depicted to show one embodiment of a support base and treadbase 104 is depicted to show one embodiment of a movable element movably coupled thereto. However, a variety of different support bases and movable elements movably coupled thereto may be employed, all of which can use exemplary embodiments of the incline motor and cam assembly of the present invention. Examples of different bases, moveable elements, and incline motor assemblies relating thereto are disclosed in U.S. patent application Ser. No. 09/496,569, filed Feb. 2, 2000, and entitled "Hiking Exercise Apparatus," which is incorporated herein by reference in its entirety, and in U.S. patent application Ser. No. 09/967,870, filed Sep. 28, 2001, and entitled "Inclining Tread Apparatus," which is incorporated herein by reference in its entirety.

Exercise apparatus 100 further includes a handrail assembly 118 coupled to the support base 102. Handrail assembly 118 can include left and right upright supports 120, 122 that are mounted on or attached to base 102. Handrail assembly 118 can support a user console 124 mounted thereon. User console 124 can include various control mechanisms to allow a user to operate exercise apparatus 100.

As depicted in FIGS. 1-2B, treadbase 104 is capable of inclining to extreme angles such that front end 114 is high above the neutral position. Exemplary embodiments of the lift apparatus of the present invention enable a user to incline and/or decline treadbase 104 to such angles. The user can optionally decline treadbase 104 to a negative angle, thus simulating walking downhill.

Figure 3:
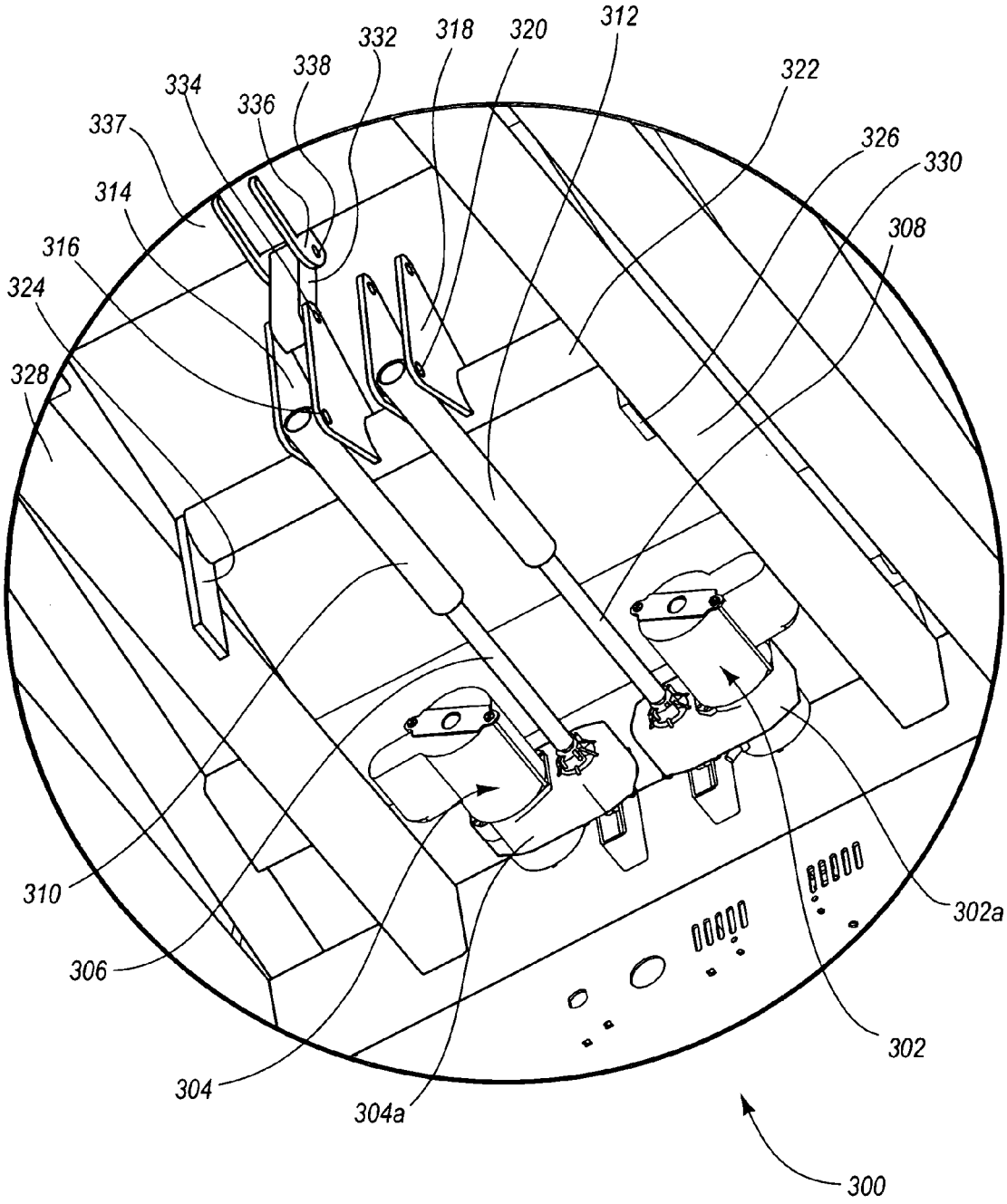
FIG. 3 is a bottom perspective view of the lift mechanism of the treadmill of FIG. 1.
Figure 4:
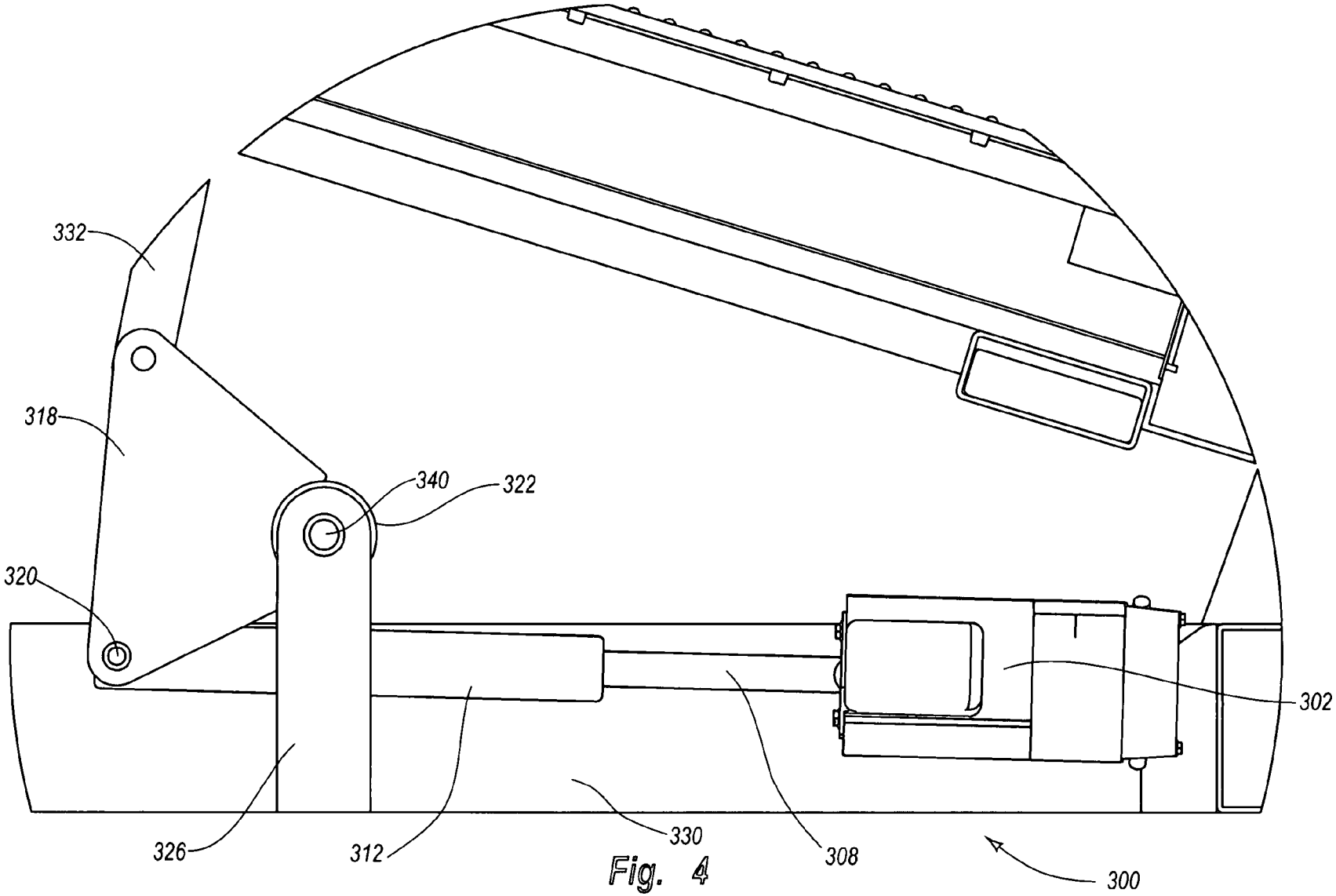
FIG. 4 is a cutaway side view of the lift mechanism of FIG. 1, showing the treadbase in an inclined configuration, as in FIG. 2B.
Figure 5:
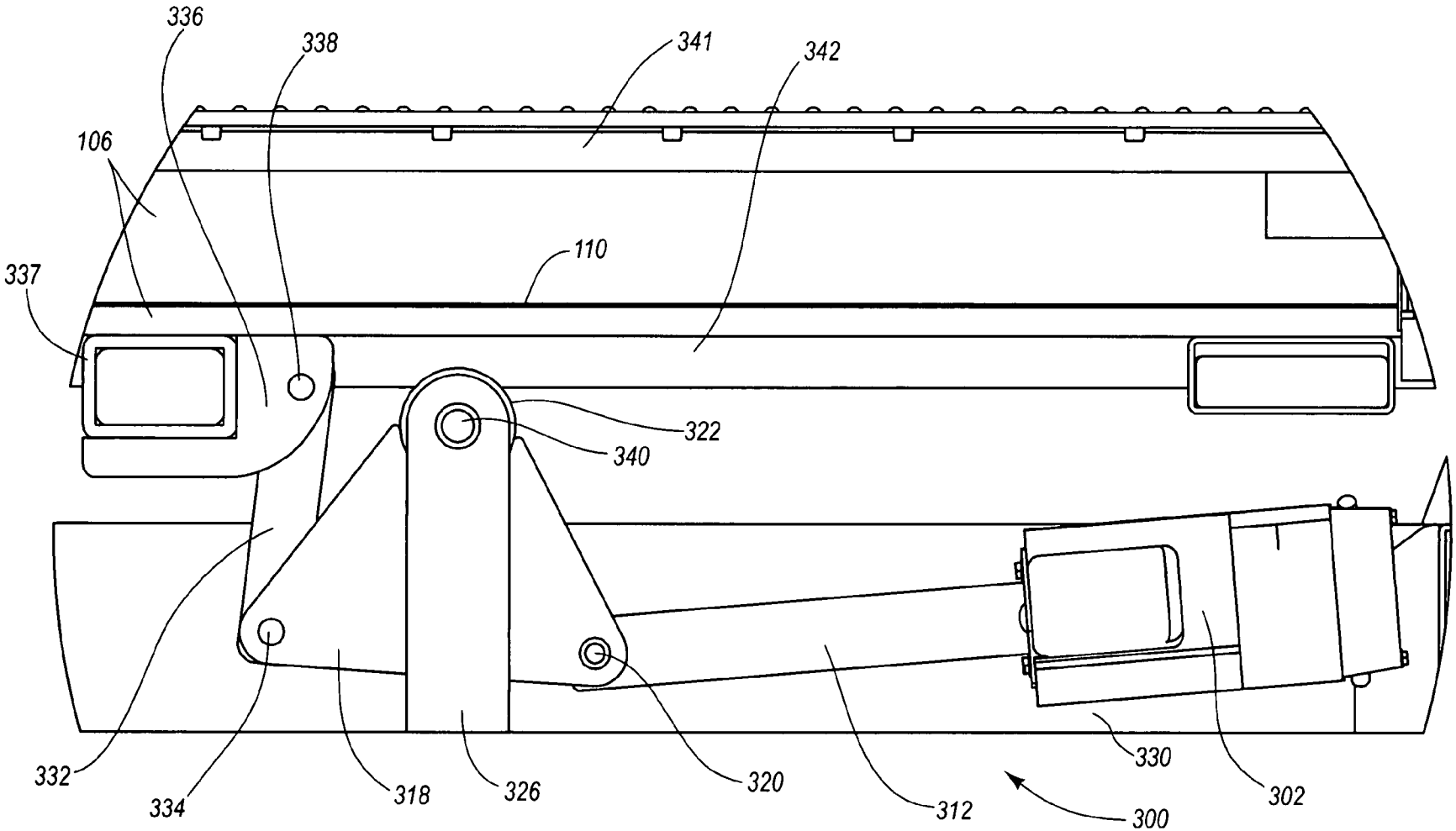
FIG. 5 is a cutaway side view of the lift mechanism of FIG. 1, showing the treadbase moved from the inclined position of FIG. 4 to a horizontal configuration, as in FIG. 2A.

FIGS. 3-5 depict different views of an exemplary embodiment of a lift apparatus 300 according to the present invention. In this exemplary embodiment, lift apparatus 300 includes a first lift motor assembly 302 and a second lift motor assembly 304, each of which are pivotally coupled at a rear end thereof to support base 102 shown in FIGS. 1-2B.

Each lift motor assembly 302, 304 comprises (i) a motor 302*a*, 304*a* pivotally coupled to base 102, (ii) a drive screw depicted at 308, 306, driven by a respective motor, and (iii) a respective sleeve. Drive screw 306 is movably connected to a sleeve 310, which in turn is linked to a cam 314. Cam 314 is pivotally connected to sleeve 310 via a pivot point 316. Drive screw 308 is movably connected to a sleeve 312, which in turn is linked to a cam 318. Cam 318 is pivotally connected to sleeve 312 via a pivot point 320.

With continued reference to FIGS. 3-5, cams 314, 318 each comprise first and second opposing plates. However, each cam 314, 318 may be formed in a variety of different configurations that perform the function of a cam herein. Cams 314, 318 are shown as attached to a torsion bar 322, which is pivotally coupled to support posts 324, 326. Support posts 324, 326 are fixed to right and left frame members 328, 330, of the support base, respectively.

In this exemplary embodiment, cam 314 is also linked to the treadbase 104. As shown, this link can be accomplished, by way of example and not limitation, by pivotally connecting the opposing plates of cam 314 to an incline link bar 332 via a pivot point 334. Incline link bar 332 is pivotally connected at an opposing end to a frame bracket 336 (via pivot point 338) affixed to the frame of treadbase 104, specifically to cross beam 337 of the frame of the treadbase 104. Cross beam 337 can be mounted to or below frame rails 106, 108 of treadbase 104. For example, cross beam 337 can be mounted to frame rails 106, 108 and/or to reinforcement rails 342 adjoined parallel to frame rails 106, 108. Thus, as shown, cam 314 is pivotally coupled to incline link bar 332, which is pivotally coupled to treadbase 104.

In the embodiment shown, the corner of cam 314 affixed to torsion bar 322 shares the pivot axis about which the torsion bar 322 pivots. Cam also has pivot points at its corners coupled to sleeve 310 and torsion bar 332. This three pivot location dynamic of cam 314 is highly effective, efficiently translating force from motor assembly 304 to treadbase 104. In another embodiment, rather than being attached to a torsion bar, a cam of the present invention having a three pivot location dynamic is pivotally coupled to a non-pivoting bar extending between posts 324 and 326, or otherwise coupled to support base 102. Thus, one or more (e.g., two, three, four, etc.) cams of the present invention may be pivotally linked to the support base 102 by being pivotally coupled to a non-pivoting bar that is immovably affixed between posts 326 and 324. However, through the use of a pivoting torsion bar, 322, the force of two or more motors is conveniently translated in a synchronized motion to movement of treadbase 104.

Lift motor assemblies 302, 304 shown in FIGS. 2-5 are extension motor assemblies. Assemblies 302, 304 use electric motors having sufficient power to smoothly raise the treadbase to any desired angle. An alternate exemplary embodiment requires only one lift motor assembly to drive cam 314. Upon actuation of motor assemblies 302, 304, respective sleeves 312, 310 move to an extended or retracted position, thereby rotating cam 314 and moving treadbase 102 to an inclined or declined position, as featured in the drawings. By way of example and not limitation, lift motor assemblies 302, 304 may comprise a Hubbell Special Products motor, Model Number M1911, although a variety of different motor assemblies may be employed.

In the exemplary embodiment shown in FIGS. 3-5, cam 314 is linked to incline link bar 332. However, alternately, incline link bar 332 or another incline link bar, is linked to cam 318. It should be noted that in the views depicted in FIGS. 4 and 5, cam 318 is shown in front, although incline link bar 332 is actually connected to cam 314, as shown in FIG. 3. In alternate embodiments, however, both cam 314 and cam 318 are linked to respective incline link bars.

Also as shown in the embodiment of FIG. 5, the lower run of the endless belt 110 is configured to move above the cross beam 337. In one embodiment, one or more isolators (not shown) may be mounted on an inside portion of frame rail 106 to support or assist with support of the treadbase deck 341.

Each plate of cam 314 is shown having a generally triangular shape. One corner of each triangular plate is fixed to torsion bar 322, with the other two corners pivotally attached to sleeve 310 and incline link bar 332, respectively. In alternate exemplary embodiments, cam 314 can have any of a large variety of shapes. Such shapes could include, by way of example and not limitation, square, circular, tetrahedonal, rhomboid, rectangular, etc. Additionally, cam 314 can be linked to the support base via other methods known to those of skill in the art. Cams 314, 318 are shown as having a pair of plates. However, this need not be the case. In alternate exemplary embodiments, a single plate cam can be employed.

In exemplary embodiments, support posts 324, 326 are attached to the frame of the support base by welding. However, those skilled in the art will realize that other methods of connecting the posts is also possible. These methods can include, by way of example and not limitation, the use of mechanical fasteners, adhesives, etc.

In operation, lift motor assemblies 302, 304 are actuated using, for example, control panel 124 (FIG. 1). The motors can optionally be actuated manually by the user to raise or lower the treadbase. Alternately, the motors can be actuated as part of a program included within the control circuitry of control panel 124.

Upon actuation, when inclination is desired, lift motor assembly 304 drives cam 314, which rotates torsion bar 322. This rotation forces incline link bar 332 to push against treadbase 104, thus lifting the treadbase 104. Additionally, lift motor assembly 302 drives cam 318 in convenient synchronization, assisting to rotate torsion bar 322.

Since the cams of respective motor assemblies 302, 304 are thus conveniently coupled to torsion bar 322 as shown, there is no need to synchronize the motor assemblies through a complicated mechanism, since both motor assemblies drive the same torsion bar. Since the motor assemblies uniformly lift the entire treadbase, this eliminates the problem of uneven lifting of one side of the treadbase frame, even for heavy users.

Additionally, drive screws 306, 308 exert a substantially linear force on cams 314, 318, respectively, which then rotates torsion bar 322, forcing incline link bar 332 substantially upwardly, so as to raise the treadbase 104. This results in a great mechanical advantage over prior art systems. Most of the force exerted by the motor assemblies 302, 304 is directed to raising the treadbase 104. In alternate exemplary embodiments, a single motor can be used.

In exemplary embodiments, drive screws 306, 308, sleeves 310, 312, cams 314, 318, torsion bar 322, support posts 324, 326, and frame members 328, 330 are made from metal. However, any materials that provide sufficient structural rigidity to allow motors 302, 304 to lift the treadbase will work and are contemplated to be within the scope of exemplary embodiments of the present invention. Such materials can include, by way of example and not limitation, wood, plastics, and composites.

In the exemplary embodiments shown in FIGS. 3-5, lift motor assemblies 302, 304 can lift the treadbase to angles of between about −3 degrees to about 15 degrees. However, those skilled in the art will realize that other angles are also possible, ranging, by way of example and not limitation, from about −10 degrees to about 50 degrees.

The embodiments of the present invention provides several advantages over lift mechanisms of the prior art. First, the lift mechanism efficiently translates force from the extension motor assemblies 302, 304 to the treadbase 104. Second, the dual motor system allows for the use of smaller, more compact motors. The system also overcomes the problems associated with trying to fit larger motors in the limited space under the treadbase, and eliminates the need to use complex and expensive synchronization mechanisms. Exemplary embodiments of the incline assembly using cams prevent one side of the treadbase frame from being lifted at an angle with respect to the other side. This greatly reduces the possibility of mechanical failure of the lift mechanism due to the torsional forces exerted when one side of the treadbase frame is lifted and the other side is not. Thus, the system disclosed herein provides for the uniform and simultaneous lifting of both sides of the treadbase frame.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A treadmill comprising:

a support base a treadbase pivotally coupled to the support base, the treadbase having an endless belt; and a lift apparatus comprising:

a lift motor assembly pivotally coupled on a first end thereof to the support base, and pivotally coupled on an opposite end thereof to a first portion of a cam at a first pivoting location, a second portion of the cam being pivotally linked to the support base at a second pivoting location, the first pivoting location of the cam being positioned beneath the second pivoting location of the cam when the treadbase is in a horizontal position; and an incline link bar having a first end and a second end, the first end of the incline link bar being pivotally coupled to a third portion of said cam and the second end of the incline link bar being pivotally coupled to the treadbase.

2. The treadmill of claim 1, wherein said second portion of said cam is attached to a torsion bar that is pivotally coupled to said support base.

3. A treadmill as recited in claim 2, further comprising:

a second lift motor assembly pivotally coupled on a first end thereof to the support base, and pivotally coupled on an opposite end thereof to a second cam, said second cam being attached to said torsion bar.

4. The treadmill of claim 1, wherein a force applied by said motor assembly to said cam results in a generally equivalent force applied to said incline link bar to raise said treadbase.

5. The treadmill of claim 1, wherein said cam has three pivot locations.

6. The treadmill of claim 1, wherein the treadbase can be selectively raised and lowered relative to the support base by a user during operation of the treadmill, and wherein the cam is driven by said at least one lift motor assembly to raise and lower the treadbase.

7. The treadmill of claim 1, wherein a torsion bar pivotally links said cam to the support base.

8. The treadmill of claim 7, wherein said cam is attached to said torsion bar and said torsion bar is pivotally attached to the support base.

9. The treadmill of claim 1, wherein said cam comprises at least one triangularly shaped plate.

10. The treadmill of claim 9, wherein a first corner of said plate is fixed to a torsion bar, said torsion bar being pivotally attached to the support base, a second corner of said plate is pivotally attached to said lift motor assembly, and a third corner of said plate is linked to the treadbase.

11. The treadmill of claim 10, wherein said third corner is pivotally attached to said incline link bar, said incline link bar being pivotally attached to the treadbase.

12. The treadmill of claim 11, wherein a force applied by said lift motor assembly to said cam results in a generally equivalent force applied to said incline link bar to raise said treadbase.

13. The treadmill of claim 1, wherein the lift motor assembly comprises a motor, a drive screw driven by the motor, and a sleeve movably coupled to the drive screw, wherein the cam is pivotally coupled to the sleeve.

14. A treadmill comprising:

a support base;

a treadbase pivotally coupled to the support base, such that the treadbase can be selectively inclined relative to the support base by a user during operation of the treadmill, the treadbase having an endless belt; and a lift apparatus comprising:

a lift motor assembly pivotally coupled on a first end thereof to a first end of the support base, and pivotally coupled on an opposite end thereof to a first portion of a cam at a first pivoting location, a second portion of the cam being pivotally linked to the support base, wherein the treadbase is selectively inclined when the first pivoting location is moved away from the first end of the support base; and an incline link bar having a first end and a second end, the first end of the incline link bar being pivotally coupled to a third portion of said cam and the second end of the incline link bar being pivotally coupled to the treadbase.

15. The treadmill as recited in claim 14, wherein said cam is driven by said at least one lift motor assembly to raise and lower the treadbase.

16. The treadmill of claim 14, wherein said cam has at least three pivot locations.

17. The treadmill of claim 14, wherein a first corner of said cam is fixed to a torsion bar, said torsion bar being pivotally attached to the support base, a second corner of said cam is pivotally attached to said lift motor assembly, and a third corner of said cam is linked to the treadbase.

18. The treadmill of claim 14, wherein a corner of said cam is pivotally attached to said incline link bar, said incline link bar being pivotally attached to the treadbase.

19. The treadmill of claim 14, further comprising a second lift motor assembly pivotally coupled to the support base at at one end of the second lift motor assembly and linked at an opposing end of the second lift motor assembly to the treadbase.

20. A treadmill comprising:

a support base a treadbase pivotally coupled to the support base, the treadbase having an endless belt; and a lift apparatus comprising:

a first lift motor assembly pivotally coupled on a first end thereof to the support base, and pivotally coupled on an opposite end thereof to one portion of a first cam, a second portion of the first cam being pivotally linked to the support base; and an incline link bar having a first end and a second end, the first end of the incline link bar being pivotally coupled to a third portion of said first cam and the second end of the incline link bar being pivotally coupled to the treadbase, wherein the treadbase can be selectively inclined relative to the support base by a user during operation of the exercise device, wherein said first cam is attached to a torsion bar, said torsion bar being linked to the support base; and further comprising a second lift motor assembly linked to a second cam, said second cam being attached to said torsion bar, wherein actuating the first and second lift motor assemblies raises said treadbase.

21. The treadmill of claim 20, wherein said first lift motor assembly is pivotally coupled to said first cam and said second lift motor assembly is pivotally coupled to said second cam.

22. The treadmill of claim 20, wherein said torsion bar is pivotally coupled to said support base.

23. The treadmill of claim 20, wherein said incline link bar is pivotally coupled on a first end thereof to said first cam and pivotally coupled on a second end thereof to said treadbase.

24. The treadmill of claim 20, wherein said first and second lift motor assemblies are pivotally coupled to said support base.

25. A treadmill comprising:

a support base a treadbase pivotally coupled to the support base, the treadbase having an endless belt; and a lift apparatus comprising:

a lift motor assembly pivotally coupled on a first end thereof to the support base, and pivotally coupled on an opposite end thereof to one portion of a cam;

a support post pivotally linking a second portion of the cam to the support base; and an incline link bar having a first end and a second end, the first end of the incline link bar being pivotally coupled to a third portion of said cam and the second end of the incline link bar being pivotally coupled to the treadbase.

* * * * *